US005839166A

United States Patent [19]

Graute

[11] Patent Number: 5,839,166

[45] Date of Patent: Nov. 24, 1998

[54] CARDING MACHINE AND PROCESS FOR PRODUCING AN AERODYNAMIC CARD WEB

[75] Inventor: Horst Graute, Coesfeld, Germany

[73] Assignee: Spinnbau GmbH, Bremen, Germany

[21] Appl. No.: 793,668

[22] PCT Filed: Aug. 3, 1995

[86] PCT No.: PCT/EP95/03088

§ 371 Date: Feb. 27, 1997

§ 102(e) Date: Feb. 27, 1997

[87] PCT Pub. No.: WO96/06964

PCT Pub. Date: Mar. 7, 1996

[30] Foreign Application Priority Data

Aug. 27, 1994 [DE] Germany ..... 44 30 500.1

[51] Int. Cl.[6] ..... D01G 21/00

[52] U.S. Cl. ..... 19/304; 19/296; 19/99

[58] Field of Search ..... 19/296, 302, 304, 19/303, 66 R, 66.2, 106 R, 109, 297, 298, 301, 305, 99, 98

[56] References Cited

U.S. PATENT DOCUMENTS 3,256,569 6/1966 Draving ..... 19/156.4

FOREIGN PATENT DOCUMENTS 0378807 7/1990 European Pat. Off. .
3832858 7/1989 Germany .
4131112 3/1993 Germany .
2268196 1/1994 United Kingdom .

*Primary Examiner*—Michael A. Neas
*Assistant Examiner*—Larry D. Worrel, Jr.
*Attorney, Agent, or Firm*—Ostrolenk, Faber, Gerb & Soffen, L.L.P.

[57] ABSTRACT

A card apparatus for producing an aerodynamically formed fibrous web (4), includes a fiber feed means (6), a main cylinder (8) rotating at high speed and a shaft (10) arranged at main cylinder (8), the shaft transporting thrown-off fibers in an airflow (12) to an air-permeable web transport means (14) and disposing said fibers on said web transport means (14) in the form of a fibrous web (4). In this apparatus the main cylinder (8) throws off said fibers at a first location (22) of shaft (10) onto a second cylinder (20) rotating at high speed in opposite sense to main cylinder (8) and generating a random orientation of said fibers on cylinder (20), and the second cylinder (20) throws off said fibers into airflow (12) at a second location (24) of shaft (10).

16 Claims, 3 Drawing Sheets

CARDING MACHINE AND PROCESS FOR PRODUCING AN AERODYNAMIC CARD WEB

BACKGROUND OF THE INVENTION

The invention refers to a card for making an aerodynamically formed fibrous web.

Such cards are known, for example, from U.S. Pat. No. 3,256,569, U.S. Pat. No. 4,064,600, U.S. Pat. No. 4,097,965, U.S. Pat. No. 4,130,915 and DE 39 01 313 A.

In known cards, after an opening and carding process, the fibers are thrown off from a main cylinder into an airflow. This airflow transports the fibers to a screen means, e.g. a screen drum or a screen band, on which the formation of the web takes place and from which a fibrous web may be doffed continuously.

Starting from prior art as of DE 39 01 313 A, it is the object of the invention to provide a card which allows for a better uniformity of the fibrous web, in particular with lighter webs, while offering high production rates.

The object is solved, according to the invention, with the features of claims 1 and 8.

SUMMARY OF THE INVENTION

Advantageously, the invention provides to employ another cylinder rotating in opposite sense with respect to the main cylinder, which first receives fibers thrown off from the main cylinder and then throws them off into a shaft. This structure is of particular importance when using fiber mixtures with greatly different values with regard to the fineness, fiber density and fiber length. The second cylinder leads to an improved homogeneity and a better random orientation of the laid web. The main cylinder and the cylinder rotating in opposite sense thereto do not contact each other. Both radii of the fittings are also at a distance from each other. The method of the invention is particularly suitable for producing lighter fibrous webs at a very high production rate.

Preferably, the peripheral speed of the second cylinder is between approximately 80 and 110% of the peripheral speed of the main cylinder. Due to the almost equal peripheral speed of the second cylinder, a combing of the fibers is reliably prevented. The fibers are thrown from the main cylinder and laid on the second drum in random orientation. Without further combing operations, these fibers are transported into the shaft, again, by centrifugal forces, the shaft being flown through substantially by the peripheral air of the two drums rotating therewith.

The fiber feed means may at the same time form a preliminary fiber opening means. Thus, a preliminary opening of the fibers is obtained.

In a preferred embodiment it is provided that a carding section is provided between the fiber feed means and the main cylinder, comprising a plurality of successive carding rolls with working rolls. The carding section causes a particularly good opening of the fibers.

In the peripheral portion containing the fibers, the main cylinder is covered with trough covers or carding elements, so that the fibers leave the main cylinder at a defined location by centrifugal force.

The airflow forming in the shaft is substantially constituted by the entrained air of the main cylinder and of the second cylinder.

The following is a detailed description of embodiments of the invention, taken in conjunction with the drawings.

DETAILED DESCRIPTION OF THE PREFERRED EMBODIMENTS

Figure 1:
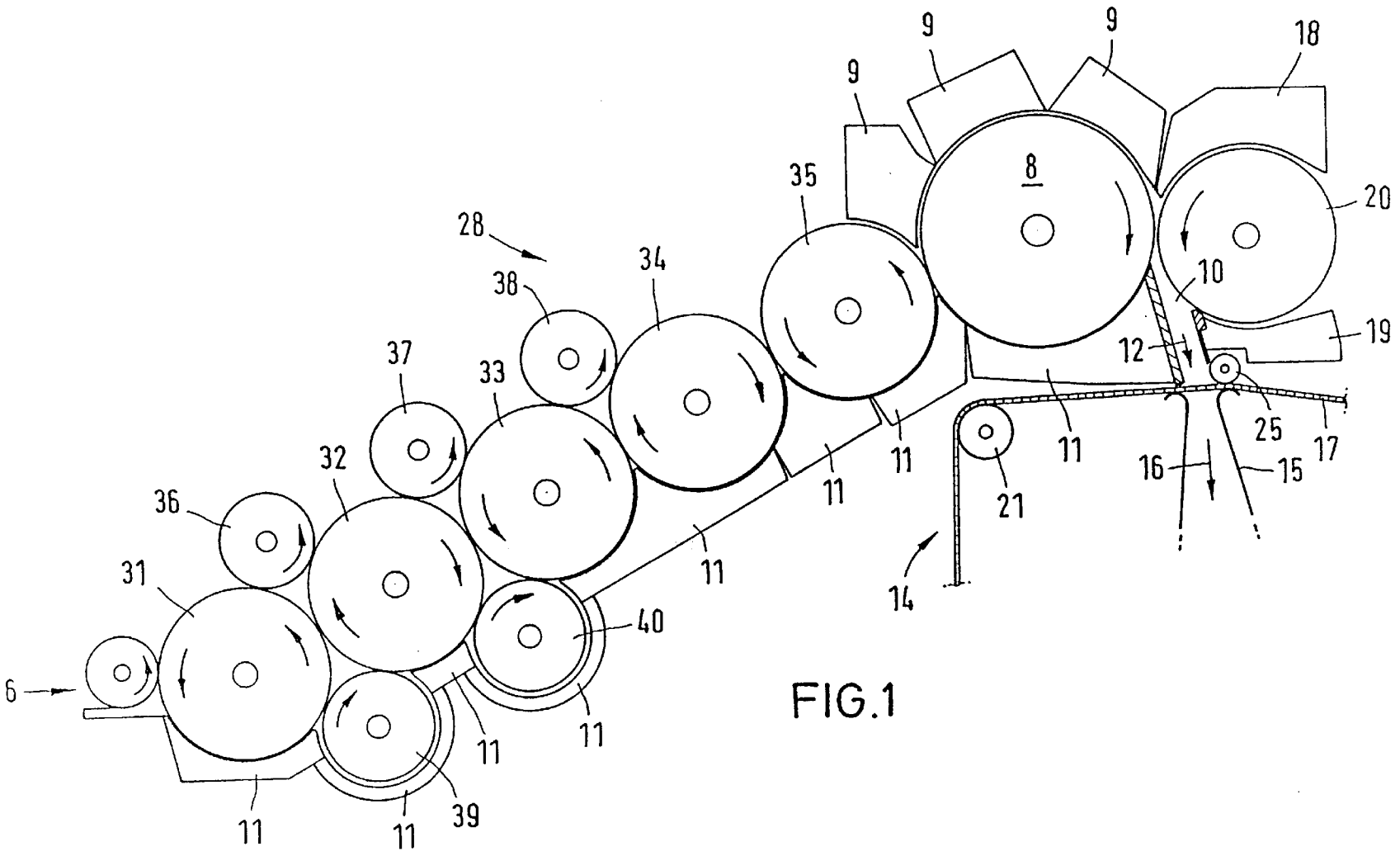
FIG. 1 shows a first embodiment of the invention with an upstream carding section.

The card of FIG. 1 comprises a non-illustrated machine frame accommodating a carding section 28, a main cylinder 8, a second cylinder 20, as well as a shaft 10 beginning between the main cylinder 8 and the second cylinder 20.

The carding section 28 has five successively arranged carding rolls 31 to 35 to which five working rolls 36 to 40 are associated. The spinning material or the supply web is fed by the fiber feed means 6 comprising a feed roll with a feeding trough. At the end of the carding section 28, the web present on the last carding roll 35 is taken over by the main cylinder 8.

From carding roll to carding roll, in the direction of the operation progress, there is provided an increase in the roll speed together with a systematic gradation of the respective fittings, thus obtaining a high carding effect for a progressive fiber isolation.

The rolls of the carding section 28, the lower working rolls 39,40 and the main cylinder 8 may be covered by trough plates 11.

On the upper side, the main cylinder 8 is covered by trough covers 9. The main cylinder 8 has a diameter of about 550 mm. The preferred peripheral speed of the main cylinder 8 ranges between 2,800 and 4,300 m/min. At the last trough cover 9 in the peripheral direction of the main cylinder 8, the extremely fine-opened fibers are loosened from the fitting of the main cylinder 8 in an explosion-like manner, due to the centrifugal forces acting on the fibers, and the fibers are thrown onto the second cylinder 20, where they are caught in an optimum random fiber orientation.

The second cylinder 20 rotates at about the same peripheral speed as the main cylinder 8, whereby it is reliably prevented that fibers are combed into the second cylinder 20. The peripheral speed of the cylinder 20 is about 80 to 110% of the peripheral speed of the main cylinder 8. The radii of the fittings of the cylinders 8, 20 do not contact each other.

The second cylinder 20 may have the same diameter as the main cylinder 8, or as represented in the drawings, it may have a smaller diameter about the size of the last carding roll 35 of the carding section 28, i.e. about 400 mm in diameter.

The second cylinder 20 has a lower trough segment 19 and an upper trough cover 18. The airflow 12 forming in the shaft 10 may be formed exclusively by the air entrained by the cylinder peripheries of the cylinders 8, 20. Additional air 23 may be taken in between the trough covers 9 and 18. The loosening of the fibers from the fittings of the cylinders 8, 20 is regulated by variably adjustable peripheral speeds and air velocities in dependence on the breast angle of the fittings and the fiber specifications.

Due to the high peripheral speed of the second cylinder 20 and after only a very short stay on the cylinder 20, the fibers are immediately thrown tangentially into the shaft 10, where they are transported in an airflow 12 to a fiber transport means 14 on which the fibers are deposited and a fibrous web 4 is produced that can be doffed continuously by means of an air-permeable conveyor belt 17 of the web transport means 14.

The air-permeable conveyor belt 17 is continuous and is deflected by deflection rollers 21 so that a section extends transversal to the airflow 12 at the end of the shaft 10. Disposing the fibers on the conveyor band 17 is assisted by a suction airflow 16. Above the conveyor belt 17, a pressure roll 25 for compacting the fibrous web 4 is arranged beside the shaft 10 in the doffing direction of the fibrous web 4.

The suction air flow is generated in a suction shaft 15 of the web transport means 14 extending beneath the conveyor belt 17.

Figure 2:
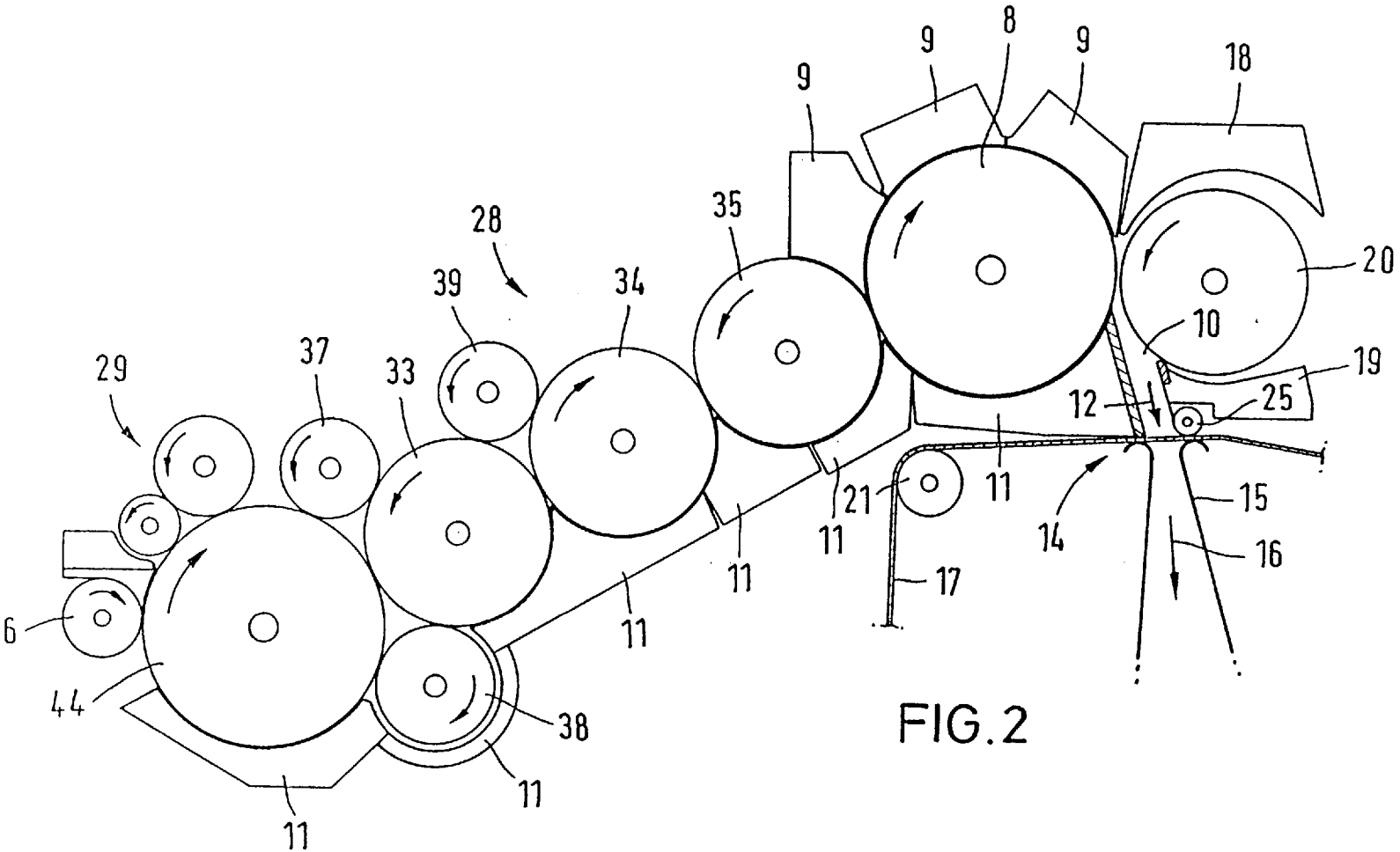
FIG. 2 shows a second embodiment with a cylinder at the beginning of the carding section.

The trough covers 9 in the embodiments of FIGS. 1 and 2 may be replaced with carding elements 42.

The embodiment of FIG. 2 differs from the embodiment of FIG. 1 in that a shorter carding section 28 is provided upstream of the main cylinder 8.

This carding section 28 has but three carding rolls 33, 34, 35, upstream of which a cylinder 44 with a pair of working and stripping rolls 29 is arranged.

Initially, a fiber feed means 6 supplies the fibrous web by means of a feed roll and a feeding trough of the drum 44. Between the drum 44 and the first carding roll 33, an upper working roll 37 and a lower working roll 38 are provided. A further working roll 39 is arranged above and between the first and the second carding roll 33, 34.

Figure 3:
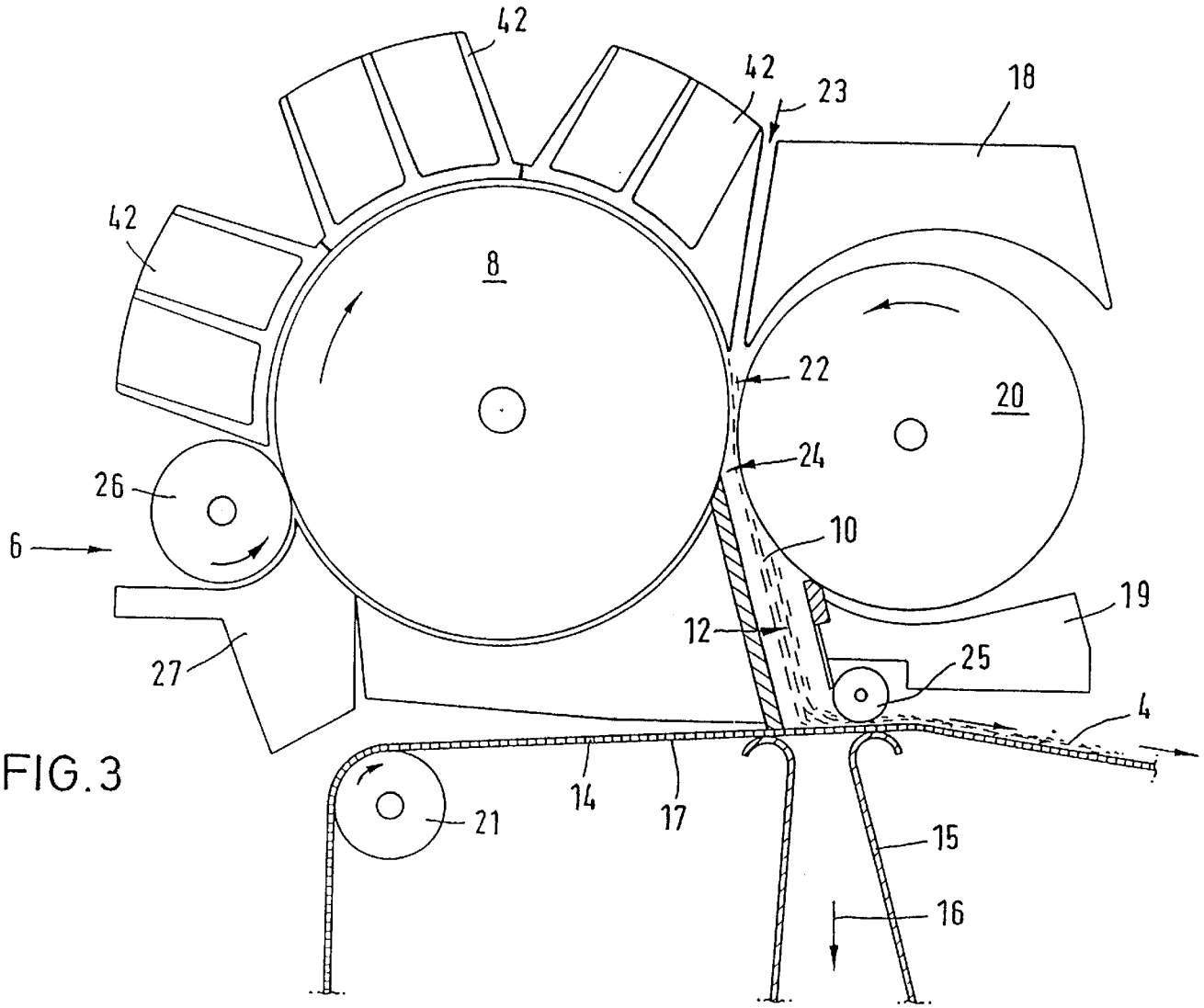
FIG. 3 shows a third embodiment without a carding section.

FIG. 3 illustrates an embodiment without a carding section, wherein a preliminary fiber opening means 6 serves as the fiber feed means at the same time. Using a roll 26 and a trough 27 of the preliminary fiber opening means 6, the supply web is preliminarily opened and transferred directly onto the main cylinder 8. In this embodiment, it is provided that carding elements 42, instead of trough covers 9, are arranged on the circumference of the main cylinder 8 between the fiber feed location at the roll 26 and the fiber discharge location 22 at the shaft 10. The carding elements 42 in the form of cardmaster plates can fine-open the preliminarily opened web into individual fibers before it is thrown off at the discharge location 22 tangentially but transversal to the shaft 10 in towards the second cylinder 20 spaced from the main cylinder 8. The fibers reach the second cylinder 20, serving as a catching means, in an optimum random orientation and are thrown off tangentially into the air flow 12 after a short stay on the cylinder 20 at the location 24, in order to be deposited onto the conveyor belt 17 of the web transport means 14 with a high uniformity in fiber distribution and in the accumulating web thickness.

As an alternative, an additional airflow 23 may be drawn between the last carding element 42, seen in the transversal direction of the main cylinder 8, and the trough cover 18.

Again, in this embodiment, the shaft 10 may be closed or sealed at its top end so that the airflow 12 is constituted only by the peripheral air of the cylinders 8, 20.

It is claimed:

1. A card apparatus for producing an aerodynamically formed fibrous web, the apparatus including a fiber feed means, a main cylinder rotating at high speed, and a shaft situated adjacent said main cylinder, said shaft transporting thrown-off fibers in an air flow flowing downstream to an air-permeable web transport means and disposing of said fibers on said web transport means in the form of a fibrous web, the improvement comprising a second cylinder parallel and adjacent the main cylinder and rotating at high speed in opposite sense to said main cylinder, where said main cylinder throws off said fibers at a first location into said shaft and thence onto said second cylinder generating a random orientation of said fibers on said second cylinder, and said second cylinder throws off by centrifugal forces said fibers which have been rotated circumferentially from said first location into said airflow at a second location of said shaft spaced downstream from said first location and thence out.

2. The card of claim 1, characterized in that the peripheral speed of said second cylinder ranges between 80 and 110% of the peripheral speed of the main cylinder.

3. An apparatus according to claim 2 wherein said main and second cylinders have peripheral speed substantially the same.

4. The card of claim 1, characterized in that said fiber feed means at the same time is a preliminary fiber opening means.

5. The card of claim 1, characterized in that a carding section with a plurality of successively arranged carding rolls is provided between said fiber feed means and said main cylinder.

6. The card of claim 5, characterized in that in said carding section, a drum with at least one pair of working and stripping rolls is arranged upstream of said carding rolls.

7. The card of claim 1, characterized in that said main cylinder has carding elements.

8. The card of claim 1, characterized in that said shaft is open at the top end.

9. The card of claim 2, characterized in that said fiber feed means at the same time is a preliminary fiber opening means.

10. A method for producing an aerodynamically formed fibrous web by feeding fibers to an opening means (18), feeding the opened fibers to a main cylinder (8) rotating at high speed, throwing the fibers off said cylinder (8) onto a second cylinder (20) rotating at high speed in opposite sense to said main cylinder (8) and transversal to an airflow (12) entrained between said cylinders (8, 20), subsequently throwing said fibers off said second cylinder (20) tangentially into said airflow (12) and depositing said fibers on an air-permeable web transport means (14) to form a web (4).

11. The method of claim 10, characterized in that said fibers pass a carding section (28) before being fed to said main cylinder (8), where they are carded several times.

12. A card apparatus according to claim 1 wherein said airflow is entrained between adjacent peripheral surfaces of said main and second cylinders and where said second cylinder throws off said fibers in a tangential direction relative to its peripheral surface.

13. The method of one of claims 10 or 11, characterized in that said fibers are carded immediately before being thrown off said main cylinder (8).

14. The method of one of claims 10 to 11, characterized in that the peripheral speed of said cylinder (20) is set to a value between about 80 and 110% of the peripheral speed of said main cylinder (8).

15. The method of claim 13, characterized in that the peripheral speed of said cylinder is set to a value between about 80 and 110% of the peripheral speed of said main cylinder.

16. The method of claim 11, characterized in that the peripheral speed of said cylinder is set to a value between about 80 and 110% of the peripheral speed of said main cylinder.

* * * * *